US006276291B1

(12) United States Patent
Lapointe et al.

(10) Patent No.: US 6,276,291 B1
(45) Date of Patent: Aug. 21, 2001

(54) ADJUSTABLE STEERING COLUMN

(75) Inventors: Luc Lapointe, Rock Forest (CA); David Kalhok, Marion, IL (US)

(73) Assignee: Bombardier Inc., Montreal (CA)

( * ) Notice: Subject to any disclaimer, the term of this patent is extended or adjusted under 35 U.S.C. 154(b) by 0 days.

(21) Appl. No.: 09/624,256

(22) Filed: Jul. 24, 2000

Related U.S. Application Data

(63) Continuation of application No. 09/186,024, filed on Nov. 4, 1998.

(30) Foreign Application Priority Data

Nov. 4, 1997 (CA) ..... 2220128

(51) Int. Cl.[7] ..... B63H 25/00

(52) U.S. Cl. ..... 114/144 R; 114/55.5; 74/89.15; 74/493; 74/551.3; 280/775

(58) Field of Search ..... 114/55.56, 55.57, 114/55.5, 144 R; 440/11; 74/89.15, 493, 551.3, 551.6; 280/775

(56) References Cited

U.S. PATENT DOCUMENTS

| | | |
|---|---|---|
| 2,000,479 | 5/1935 | Cook et al. . |
| 2,365,830 | 12/1944 | Miller . |
| 4,495,834 | 1/1985 | Bauer et al. . |
| 4,688,817 | 8/1987 | Marier . |
| 4,893,518 | 1/1990 | Matsumoto et al. . |
| 4,903,540 | 2/1990 | Beauch . |
| 5,054,798 | 10/1991 | Zulawski . |
| 5,480,365 | 1/1996 | Lundin et al. . |

OTHER PUBLICATIONS

Photocopy of Kawasaki Brochure, date unknown.

Prior Art Declaration executed by Renald Plante with attached Exhibits A–D.

*Primary Examiner*—S. Joseph Morano
*Assistant Examiner*—Ajay Vasudeva
(74) *Attorney, Agent, or Firm*—Pillsbury Winthrop LLP

(57) ABSTRACT

An adjustable steering column for use with a personal watercraft. The adjustable steering column comprises a steering column base fixed to the watercraft, an upper steering column connected to the steering column base, the upper steering column being movable between a first position and second position, and an adjustment mechanism for moving the upper steering column between the first and second positions. Preferably, the adjustment mechanism includes a screw with a knob on one end and a ball joint on the other end. The adjustment screw is manually operable to pivot the upper steering column with respect to the steering column base.

10 Claims, 4 Drawing Sheets

ADJUSTABLE STEERING COLUMN

This is a continuation of application Ser. No. 09/186,024, filed Nov. 4, 1998.

FIELD OF THE INVENTION

The present invention pertains to personal watercraft, and more particularly to an apparatus for adjusting the height and inclination of a steering column mounted on a personal watercraft.

BACKGROUND OF THE INVENTION

Since the introduction ten years ago of the first sit-down personal watercraft (PWC), the design of these products has evolved rapidly to meet the varied needs of riders, both recreational and competitive. The factors that typically determine the design of personal watercraft are power, acceleration, stability, fuel efficiency, safety, appearance and ergonomics. From an ergonomic standpoint, the height of the handlebars is an important factor in the overall level of comfort for riders of personal watercraft. Handlebars that are either too low or too high may make it difficult to effectively steer the personal watercraft and, furthermore, may tire the rider's arms if he or she has to hold them in an uncomfortable position. Not only is the positioning of the steering column important, but the positioning should preferably be accomplished quickly and easily. Since personal watercraft are often rented out at resorts or shared among friends and family, it is particularly advantageous if the positioning of the steering column can be accomplished quickly and easily, without the need for tools, to accommodate riders of varying height. Heretofore, however, manufacturers of personal watercraft have not concentrated much on making steering columns adjustable. Thus, there is a need to design a personal watercraft whose steering column can be quickly and easily adjusted to a height appropriate for each rider.

OBJECT AND STATEMENT OF THE INVENTION

It is thus the object of the present invention to provide a personal watercraft steering column that is adjustable so that riders can quickly and easily adjust the steering column, and hence the handlebars, to a height and inclination that optimizes their comfort.

Thus, the present invention seeks to provide an adjustable steering column for use with a personal watercraft, said adjustable steering column comprising a steering column base fixed to said watercraft, an upper steering column pivotally connected to said steering column base, said upper steering column being pivotable between a first position and second position, and an adjustment mechanism for moving said upper steering column between said first and second positions. This arrangement is advantageous because the angle and position of the steering column can be easily and quickly adjusted to suit the rider.

Preferably, the adjustment mechanism includes an adjustment screw with a knob at one end. This arrangement allows the adjustable steering column to be positioned quickly and easily without the use of tools.

Other objects and features of the invention will become apparent by reference to the following description and drawings.

BRIEF DESCRIPTION OF THE DRAWINGS

A detailed description of the preferred embodiments of the present invention is provided hereinbelow with reference to the following drawings, in which.

Figure 1:
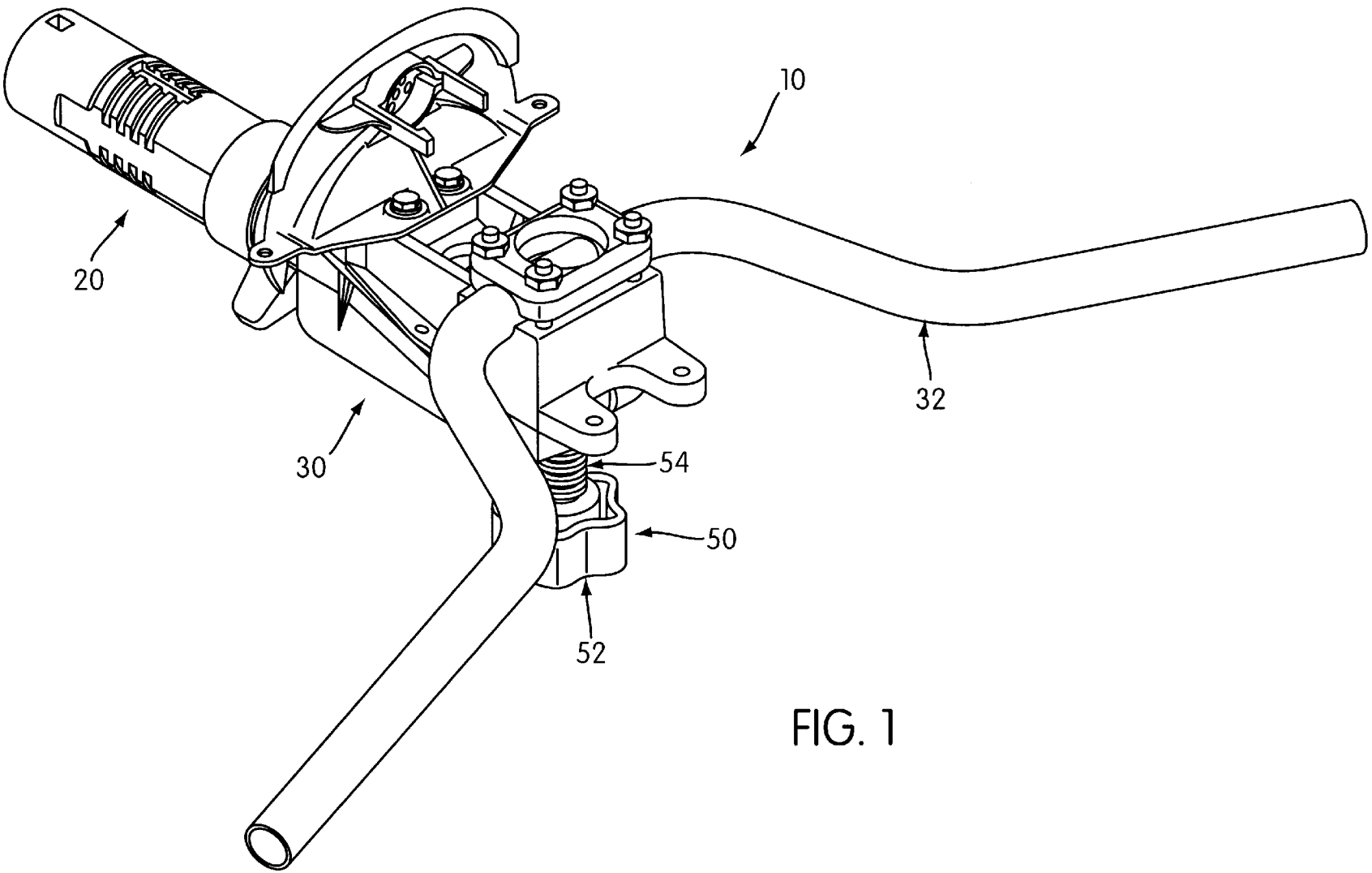
FIG. 1 is a perspective view of an adjustable steering column in accordance with the invention.

In the drawings, the preferred embodiments of the invention are illustrated by way of example. It is to be expressly understood that the description and drawings are only for purposes of illustration and to facilitate understanding, and are not intended to be a definition of the limits of the invention.

DETAILED DESCRIPTION OF PREFERRED EMBODIMENTS

Referring to FIG. 1, an adjustable steering column 10 of the present invention comprises a steering column base 20 and an upper steering column 30. A handlebar 32 is mounted on the upper steering column 30 for steering a personal watercraft.

Figure 2:
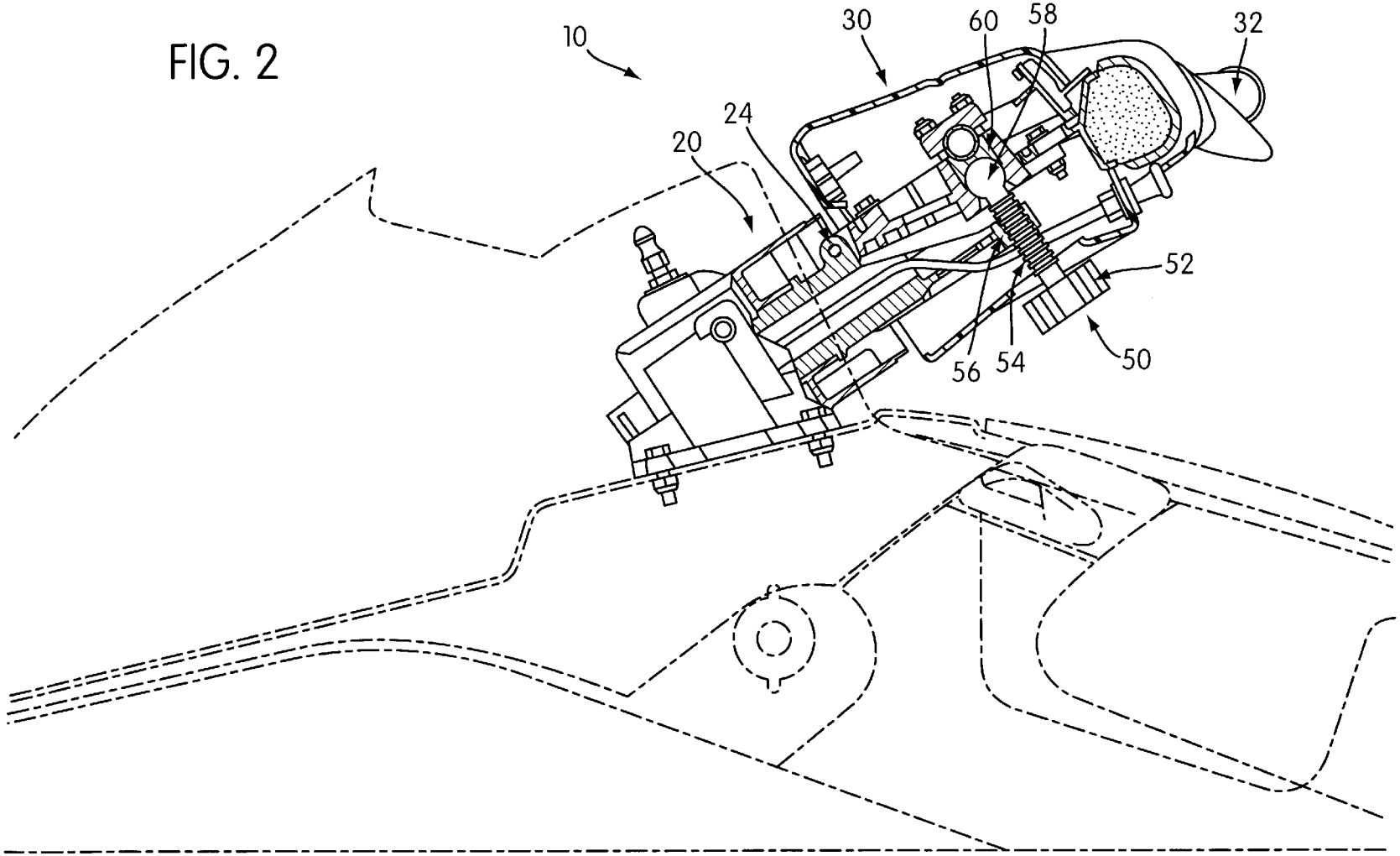
FIG. 2 is a side elevational view of the adjustable steering column shown in FIG. 1, wherein the adjustable steering column is in its nominal (intermediate) position.
Figure 3:
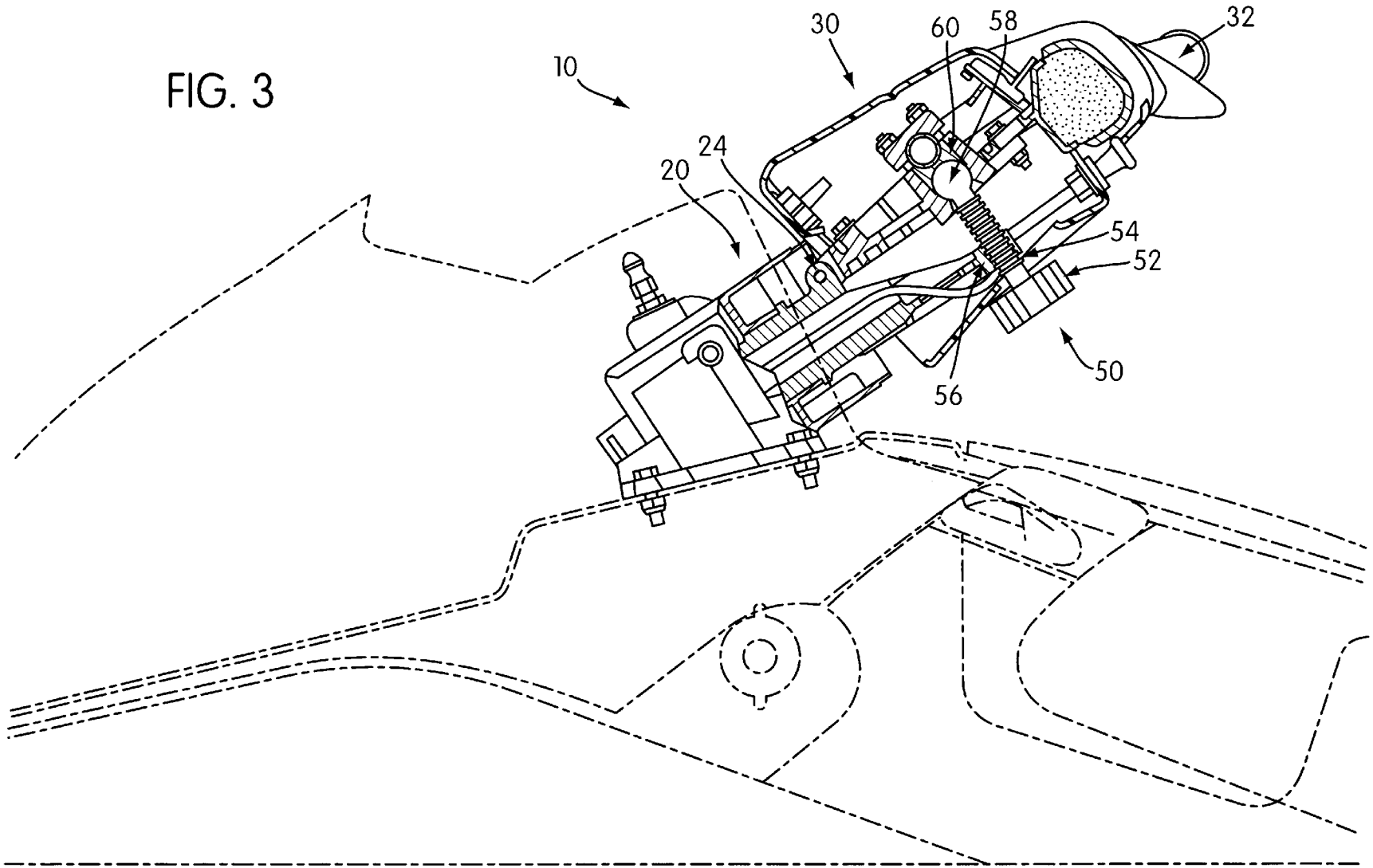
FIG. 3 is a side elevational view of the adjustable steering column shown in FIG. 1, wherein the adjustable steering column is in its highest position.
Figure 4:
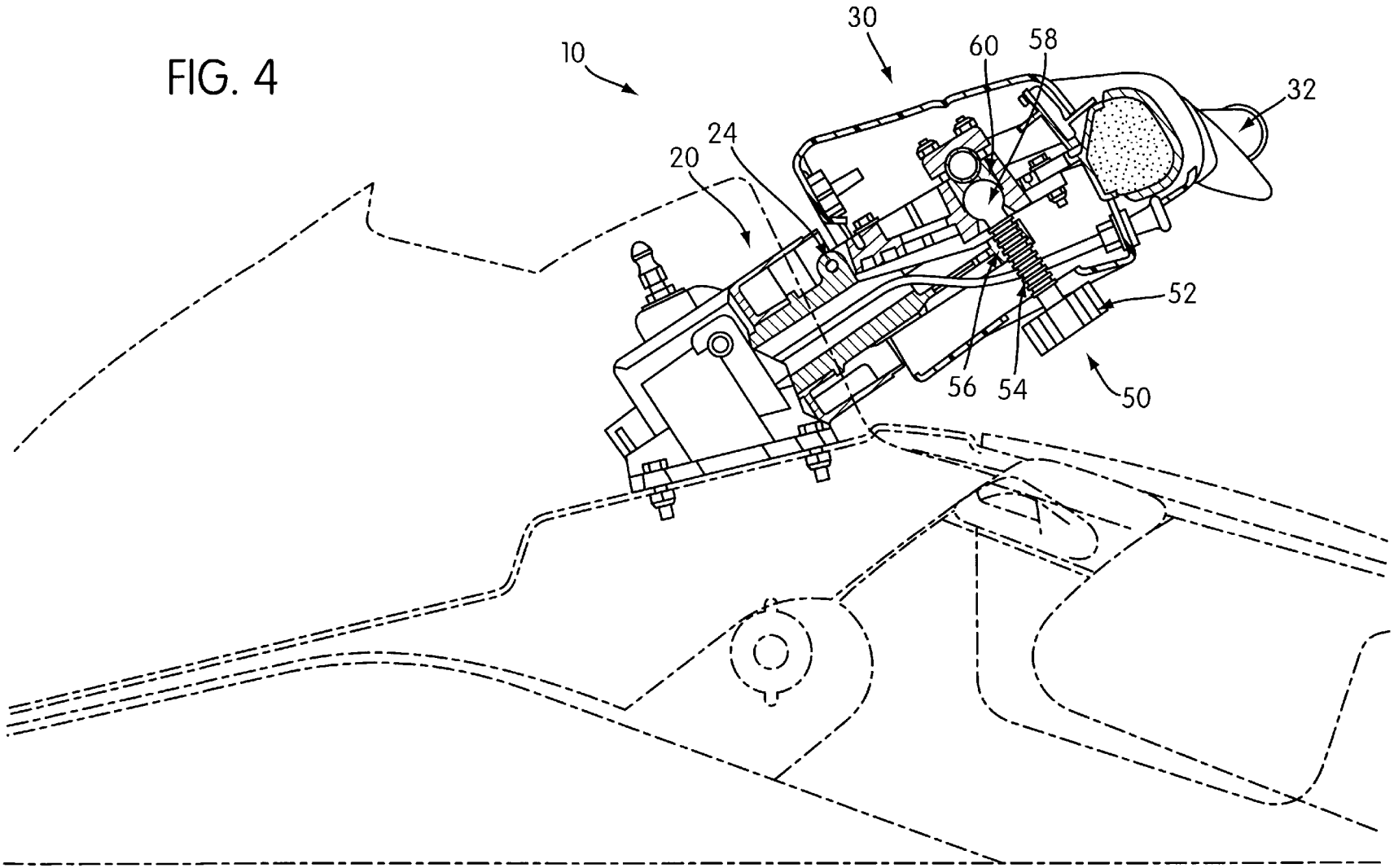
FIG. 4 is a side elevational view of the adjustable steering column shown in FIG. 1, wherein the adjustable steering column is in its lowest position.

Referring to FIGS. 2–4, the upper steering column 30 pivots with respect to the steering column base 20 about a revolute joint 24. To adjust the height and inclination of the upper steering column 30 with respect to the steering column base 20, the rider simply turns an adjustment screw 50.

The adjustment screw 50 comprises an adjustment knob 52 located at one end of a threaded shaft 54. The threaded shaft 54 screws through a threaded housing 56 having a matching pitch. The threaded housing 56 is connected rigidly to the steering column base 20. At the other end of the adjustment screw 50, the threaded shaft 54 is connected to a ball end 58 which forms a spherical joint with a ball housing 60. The ball housing 60 is connected rigidly to the upper steering column 30.

To raise the upper steering column 30 and the handlebar 32 with respect to the steering column base 20, the rider turns the adjustment knob 52 clockwise (from the perspective of the rider) thereby causing the threaded shaft 54 (assuming right-handed threads) to advance through the threaded housing 56. When the threaded shaft 54 advances through the threaded housing 56, the ball end 58 exerts an upward force on the ball housing 60. This upward force is transferred to the upper steering column 30 and thus causes the upper steering column 30 to pivot upward about the revolute joint 24.

Conversely, to lower the upper steering column 30 and the handlebar 32 with respect to the steering column base 20, the rider turns the adjustment knob 52 counterclockwise (again from the perspective of the rider) thereby causing the threaded shaft 54 (again assuming right-handed threads) to retreat through the threaded housing 56. When the threaded shaft 54 retreats through the threaded housing 56, the ball end 58 exerts a downward force on the ball housing 60. This downward force is transferred to the upper steering column 30 and thus causes the upper steering column to pivot downward about the revolute joint 24.

To construct the components of the foregoing description, standard engineering materials, which are well-known to those skilled in the art, would suffice. Specifically, in the preferred embodiment, the adjustment screw 50 would be constructed of nylon. The ball housing 60 and the threaded housing 56 would also be made of nylon or of an equivalent material which would minimize wear of the threaded shaft 54 and of the ball end 58. The revolute joint 24 would be any standard bearing or bushing, the selection of which is well established in the art. Finally, the methods and materials required to design and construct the remaining components of the adjustable steering column 10 are well known to those skilled in the art.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. In a personal watercraft, the improvement comprising:

an adjustable steering assembly comprising:

(i) a steering column base portion;

(ii) an adjustable steering column portion having a manually engageable steering input structure constructed and arranged to be moved in a steering manner by an operator seated on said personal watercraft, said adjustable steering column portion being movably mounted to said steering column base portion (a) for generally vertical adjusting movements through a range of operating positions relative to said steering column base portion and (b) such that movement of steering input structure by an operator affects steering movement of said steering column base portion; and (iii) an adjustment mechanism operatively connected to said adjustable steering column portion, said adjustment mechanism being constructed and arranged (a) to be operated so as to adjustably move said adjustable steering column portion to a selected operating position within said range of operating positions and (b) to thereafter fix said adjustable steering column at said selected operating position thereof.

2. A personal watercraft according to claim 1, wherein said adjustable steering column portion is pivotally mounted to said steering column base portion such that said adjusting movements thereof are about a pivotal axis.

3. A personal watercraft according to claim 1, wherein said adjustment mechanism is manually movable to affect said adjusting movements of said adjustable steering column portion.

4. A personal watercraft according to claim 1, wherein said adjustment mechanism is operatively connected between said steering column base portion and said adjustable steering column portion.

5. A personal watercraft according to claim 4, wherein said adjustment mechanism includes a threaded member movably mounted to said adjustable steering column portion and wherein said steering column base portion has structure defining a threaded bore, said threaded member being received in said threaded bore such that rotation of said threaded member within said bore moves said threaded member axially to effect relative movement between said adjustable steering column portion and said steering column base portion.

6. A personal watercraft according to claim 5, wherein said threaded member has ball at one end thereof and wherein said adjustable steering column portion has a socket, said ball being received in said socket so as to movably mount said threaded member to said adjustable steering column portion.

7. A personal watercraft according to claim 6, wherein said threaded member has a knob fixed on an end thereof opposite said ball, said knob being manually rotatable to rotate said threaded member.

8. A personal watercraft according to claim 7, wherein said knob is located below said adjustable steering column portion.

9. A personal watercraft according to claim 1, wherein said manually engageable steering input structure is a handlebar.

10. A watercraft comprising:

a steering column base fixed to said watercraft;

an upper steering column pivotally connected to said steering column base, said upper steering column being pivotally movable between a first position and a second position; and a manually operable adjustment mechanism for moving said upper steering column between said first and second positions, wherein said upper steering column comprises a ball housing and wherein said adjustment mechanism including an adjustment screw having a ball at one end received in said ball housing and a knob on the other end, whereby turning of said screw causes said upper steering column to pivot with respect to said steering column base.

* * * * *